United States Patent [19]

Demukai et al.

[11] Patent Number: 4,913,215

[45] Date of Patent: Apr. 3, 1990

[54] BENDABLE MULTIPLE WINDOW

[75] Inventors: Enzo Demukai, Higashi-osaka; Haruto Monobe, Wakayama, both of Japan

[73] Assignee: Nippon Door Check Mfg. Co., Ltd., Osaka, Japan

[21] Appl. No.: 57,804

[22] Filed: Jun. 3, 1987

[30] Foreign Application Priority Data

| | | | |
|---|---|---|---|
| Jun. 5, 1986 | [JP] | Japan | 61-85533 |
| Jun. 5, 1986 | [JP] | Japan | 61-85534 |
| Jun. 5, 1986 | [JP] | Japan | 61-85535 |
| Jun. 5, 1986 | [JP] | Japan | 61-85536 |
| Aug. 12, 1986 | [JP] | Japan | 61-124512 |

[51] Int. Cl.[4] ..... E05D 15/26

[52] U.S. Cl. ..... 160/207

[58] Field of Search ..... 160/207, 201, 206, 88, 160/187

[56] References Cited

U.S. PATENT DOCUMENTS

| | | | |
|---|---|---|---|
| 784,896 | 3/1905 | Schommer | 160/207 X |
| 1,733,694 | 10/1929 | Price | 160/207 X |
| 1,757,048 | 5/1930 | Janeczko | 160/207 |
| 1,813,474 | 7/1931 | Ward | 160/207 |
| 2,771,133 | 11/1956 | Haskell | 160/207 X |
| 4,138,150 | 2/1979 | Bills | 292/60 X |
| 4,141,403 | 2/1979 | Church | 160/201 |
| 4,374,537 | 2/1983 | Lindbergh | 160/207 X |
| 4,443,035 | 4/1984 | Saemann | 160/207 X |

*Primary Examiner*—Blair M. Johnson

*Attorney, Agent, or Firm*—Barnes, Kisselle, Raisch, Choate, Whittemore & Hulbert

[57] ABSTRACT

In a window attaching framework in a building, upper and lower windows are foldably connected together, and one or a plurality of dampers or arms are installed between at least either the upper window or the lower window and the window attaching framework. Such dampers or arms prevents the windows from rapidly moving downward when opened, making it possible to effect smooth opening and closing of the windows.

1 Claim, 20 Drawing Sheets

BENDABLE MULTIPLE WINDOW

FIELD OF THE INVENTION

The present invention relates to a bendable multiple window comprising at least two windows, upper and lower, connected together by hinges so that they can be opened and closed by being bent along the connecting region.

BACKGROUND OF THE INVENTION

Heretofore, the opening and closing of windows has been based selectively on either the swing system or the slide system. Particularly in high-rise buildings, windows are constructed so that they cannot be opened beyond a certain degree to prevent falling. Such construction has a problem that sufficient ventilation is impossible.

Thus, a multiple window such as the one disclosed in Japanese Utility Model Application Laid-Open No. 69533/1974 is known. The multiple window disclosed therein comprises two windows, upper and lower, connected together and adapted to be opened and closed by being bent along the connecting portion by means of hinges, the arrangement being such that when the two windows are bent for opening, the upper end of the upper window slides down along guides formed in the opposite lateral frames of a window attaching framework.

When the multiple window disclosed in Japanese Utility Model Application Laid-Open No. 69533/1974 is opened, the upper end of the upper window moves downward, whereby openings for ventilation are defined in the opposite lateral regions of the upper and lower windows and in the region above the upper window. When the upper end of the upper window moves downward, the upper end of the upper window hits the lower end portions of the guides with a shock owing to the weight of the upper window, often resulting in earlier wear or damage to both. Further, when the upper and lower windows are to be closed, a force is required to raise the upper window, making it necessary to close with a heavy force.

DISCLOSURE OF THE INVENTION

An object of the invention is to prevent shocks from occurring during the opening and closing of windows, and to ensure smooth opening and closing of windows.

To achieve this object, the bendable multiple window of the invention is characterized by comprising a window attaching framework installed in a building, upper and lower windows vertically connected together in the window attaching framework and bendably constructed along the connecting region, and damper means or arm means installed between at least one of the upper and lower windows and the window attaching framework.

According to this construction, because of the provision of the damper means or arm means, the opening and closing of the upper and lower windows can be smoothly effected. Further, under the action of the damper means or arm means, the upper and lower windows can be slowly opened and closed, thereby avoiding shocks occurring during opening and closing.

DESCRIPTION OF THE EMBODIMENTS

Figure 1:
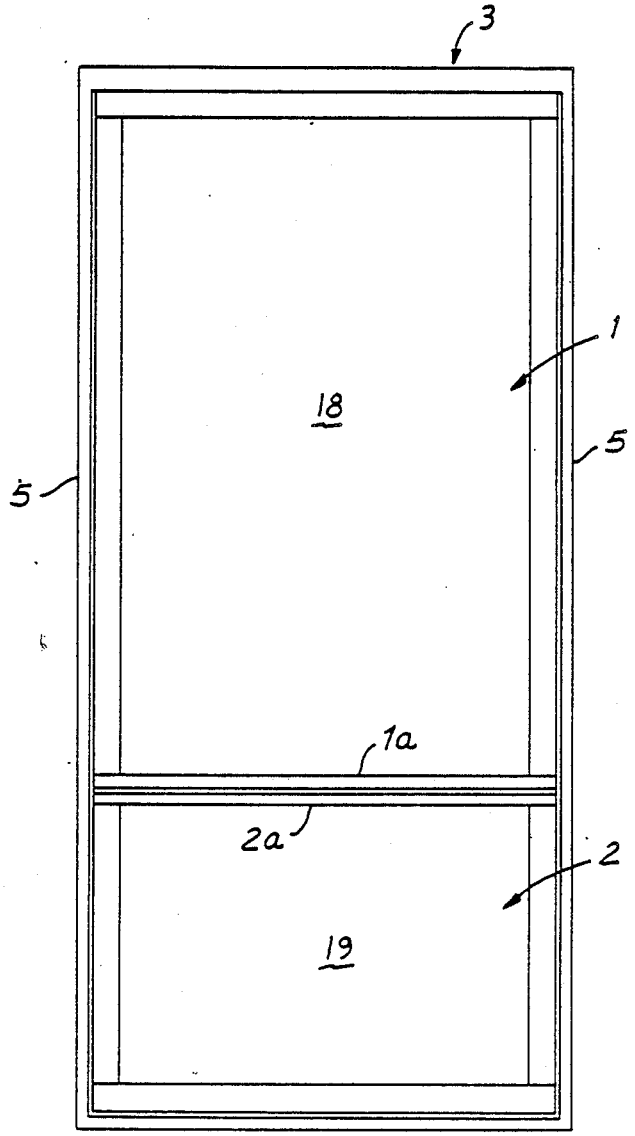
FIG. 1 is a front view schematically showing the arrangement of the first embodiment of a bendable multiple window according to the invention.

The first embodiment of the invention will now be described with reference to FIGS. 1 through 8.

In the drawings, the numerals 1 and 2 denote upper and lower windows installed in a window attaching framework 3 in a building. The lower end frame 1*a* of the upper window 1 and the upper end frame 2*a* of the lower window 2 are bendably connected together by hinges 4 each having a horizontal shaft. The right and left lateral frames 5 of the window attaching framework 3 are formed with vertical guide grooves 6. Rollers 7 are installed on the opposite lateral sides of the lower end portion of the lower window 2 and vertically slidably fit in said guide grooves 6.

The numeral 8 denotes bearings respectively attached to the right and left lateral frames 5 to support the upper window 1 at the opposite lateral sides of its upper end for rotation around a horizontal axis, said bearings being formed with holes 9, and the shaft portions 11 of blocks 10 attached to the upper end surface of the upper window 1 on opposite sides fit in said holes 9 so as to rotatably support the upper end of the upper window 1.

The numeral 12 denotes blocks respectively attached to the lower end surface of the lower window 2 on opposite sides to attach the rollers 7 to the opposite lateral sides of the lower end portion of said window 2, each roller 7 rotatably fitting on the front end 13*a* of a shaft 13 which is horizontally inserted in the associated block 12. Each block 12 contains a spring 14 fitting on the shaft 13 to urge the shaft 13 to fit in the roller 7. The urging force of the spring 14 moves the shaft 13 toward the roller 7 until its front end 13*a* fits in the roller 7.

By virtue of the urging force of the spring 14, the shaft 13 extends through the roller 7 with its front end 13*a* fitting any one of the holes 16 of a locking plate 15 disposed parallel to the guide groove 6 to support the lower end of the lower window 2 when this window 2 is opened to a certain degree. A pair of flanges 13*b* and 13*c* axially spaced a suitable distance from each other are formed on the other end of the shaft 13. In use, the outer flange 13*b* is gripped by hand to operate the shaft 13 with respect to said roller 7 and holes 16. It is arranged that when the front end 13*a* of the shaft 13 is inserted in a desired one of the holes 16, the flange 13*c* abuts against the end surface of the block 12.

To prevent the front end 13*a* of the shaft 13 from being urged by the spring 14 to project through the roller 7 when the lower window 2 is opened and closed, a pin 17 is set in the shaft 13 at right angles to the axis of the shaft 13 at a position spaced from the flange 13*c* axially toward the middle of the shaft 13 by a distance equal to the depth of the hole 16. By the pin 17 abutting against the end surface of the block 12, the front end 13*a* of the shaft 13 is prevented from projecting through the roller 7. When the front end 13*a* of the shaft 13 is to be allowed to fit in a desired one of the holes 16, the shaft 13 is rotated until the pin 17 is brought to a groove 12*a* formed in the end surface of the block 12 and in this state the pin 17 is allowed to fit in the groove 12*a* under the influence of the urging force of the spring 14. The holes 16 in the locking plate 15 are vertically spaced a suitable distance from each other (in the illustrated embodiment, there are three holes 16). The numerals 18 and 19 denote the glass portions of the windows 1 and 2.

The lower window 2 is connected and supported through dampers 20 respectively disposed between the right and left lateral frames 5 of the window attaching framework 3 and the lower end of the window 2. More particularly, each damper 20 has a body 20*a* containing a spring (not shown) which pulls a rod 20*b* so that it is urged in the contracting direction. The upper end of each damper 20, i.e., the upper end of the body 20*a* is pivotally connected to the associated lateral frame 5 of the window attaching framework 3 by an attaching element 21. The lower end of each damper 20, i.e., the front end of the rod 20*b* is pivotally connected to the associated block 12 attached to the lower end of the lower window 2 on one side.

Therefore, when the connecting portion defined by hinges 4 between the upper and lower windows 1 and 2 is pushed to open the windows, the upper window turns around the axes of the shaft portions 11 while the lower window 2 turns around the axes of the shafts 13 while moving upward as it is assisted by the urging forces of the dampers 20. As a result, the upper and lower windows 1 and 2 are simultaneously opened; at this time, the lower window 2 can be opened lightly under the pulling forces of the dampers 20. When the upper and lower windows 1 and 2 are to be closed, they will be likewise closed.

The provision of the dampers 20 ensures slow opening and closing of the windows 1 and 2, avoiding shocks occurring during opening and closing operation.

In the opening and closing of such windows 1 and 2, the shafts 13 installed in the blocks 12 are maintained with their front ends 13*a* extracted from said holes 16. If the shafts 13 are rotated for the pins 17 to fit in the grooves 12*a* when the upper and lower windows 1 and 2 are opened to a desired degree, the shafts 13 are moved toward respective desired holes 16 until their front ends 13*a* fit in said holes 16, thereby maintaining the opened state of the windows 1 and 2. When the windows 1 and 2 are to be closed, the front ends 13*a* of the shafts 13 are extracted from the holes 16 and then the shafts 13 are rotated to allow the pins 17 to abut against the end surfaces of the blocks 12.

Figure 2:
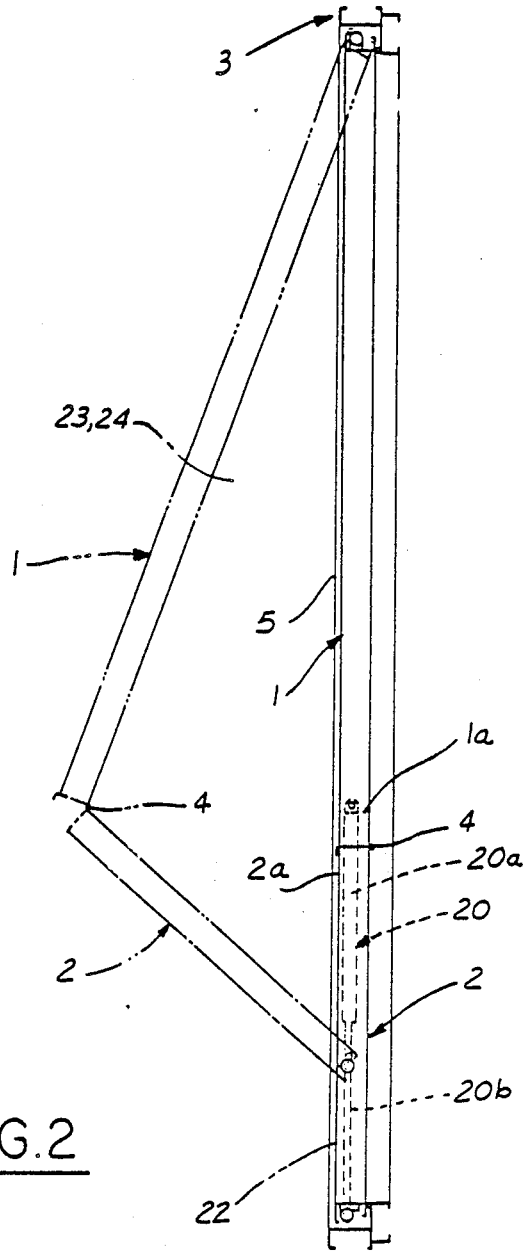
FIG. 2 is a side view schematically showing the arrangement of the bendable multiple window of FIG. 1.
Figure 3:
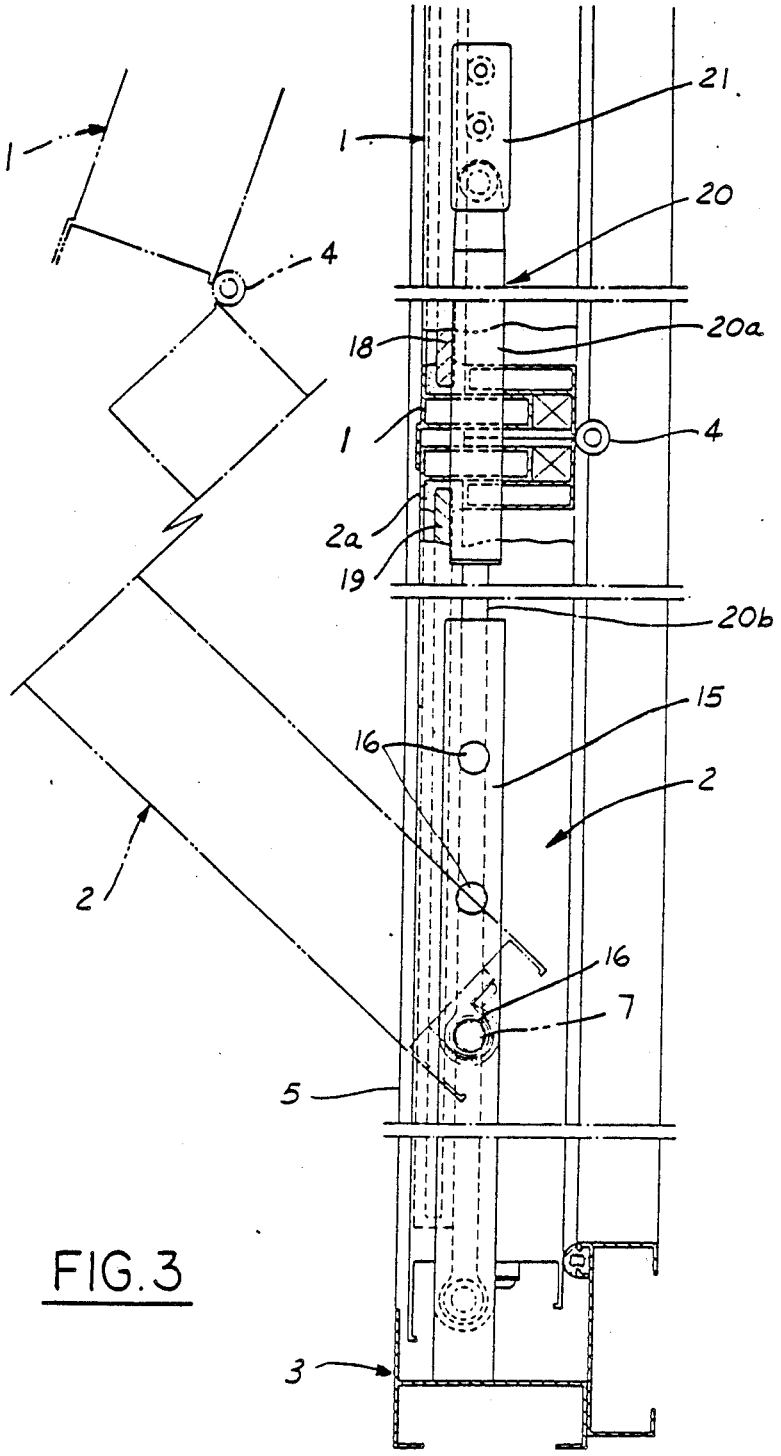
FIG. 3 is an enlarged fragmentary side view of the damper attaching portion of FIG. 2.
Figure 4:
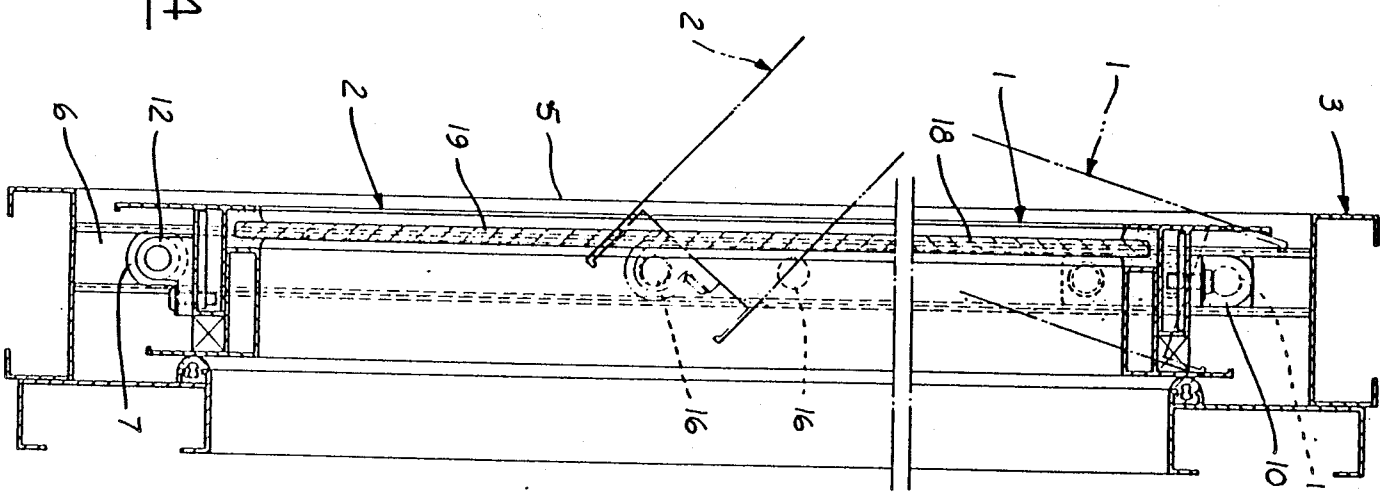
FIG. 4 is an enlarged side view, in section, of the upper and lower end portions of the bendable multiple window of FIG. 2.
Figure 5:
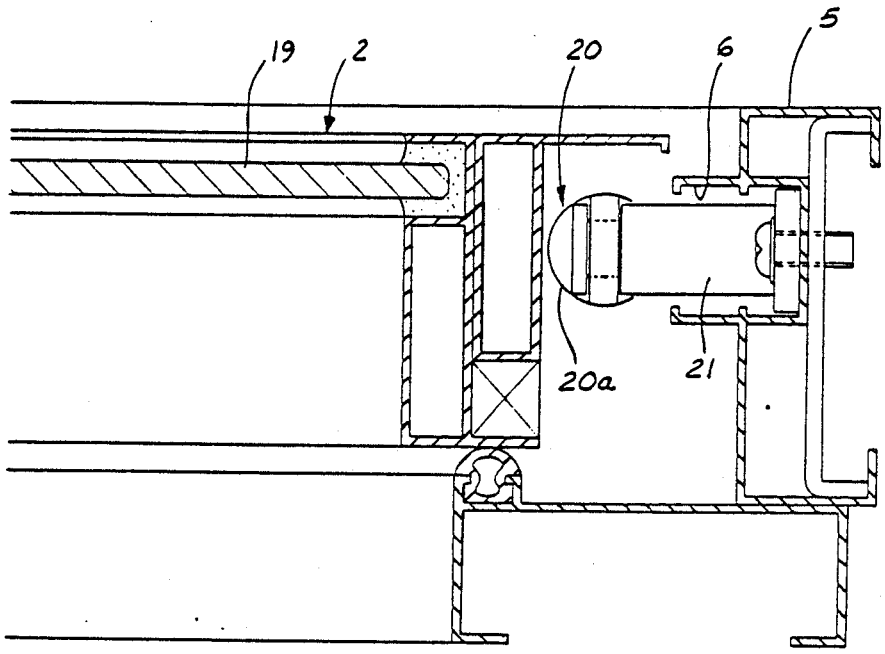
FIG. 5 is an enlarged plan view, in section, of the damper attaching portion of FIG. 2.
Figure 6:
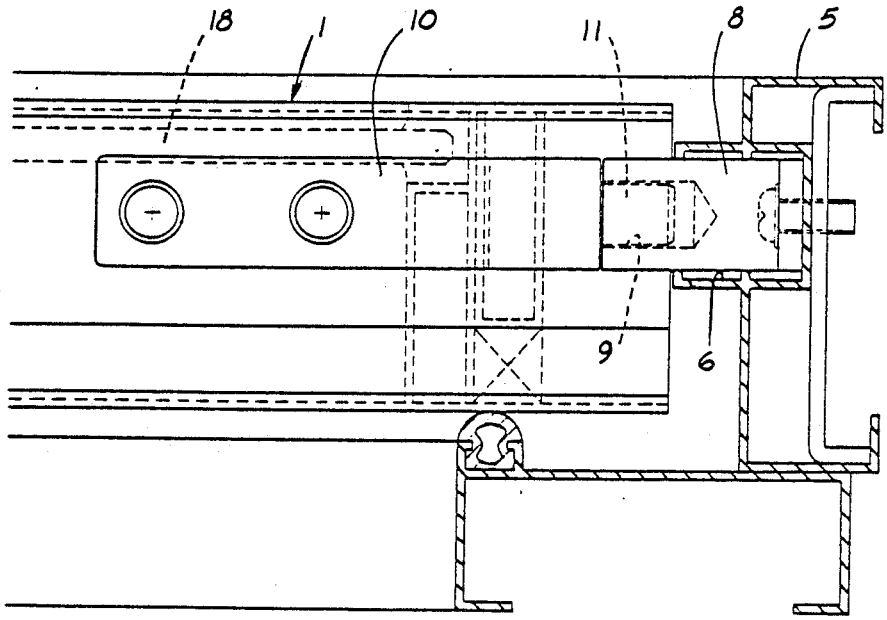
FIG. 6 is an enlarged plan view, in section, of the pivot portion of the upper window of FIG. 2.
Figure 7:
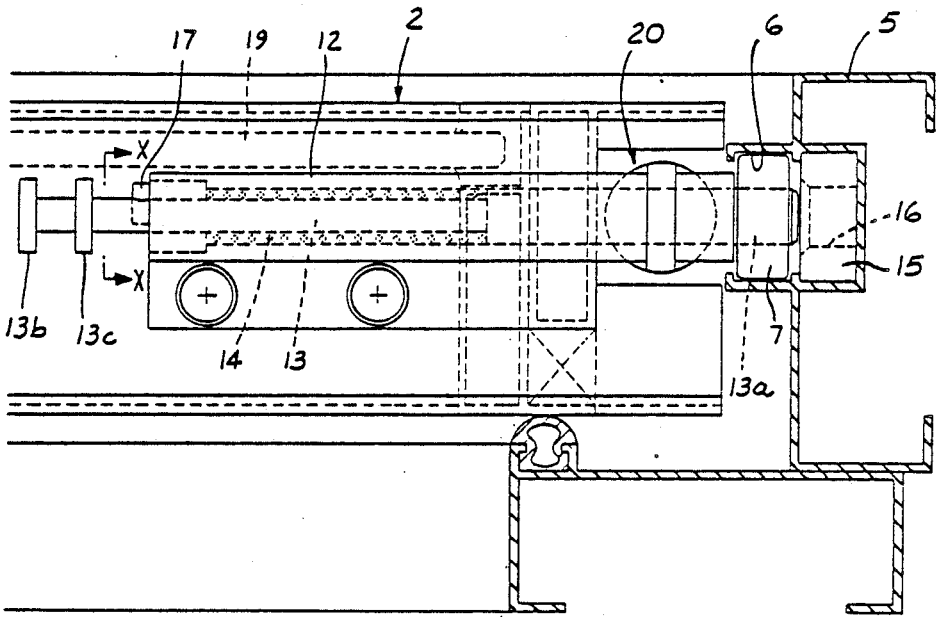
FIG. 7 is an enlarged bottom view, in section, of the roller attaching portion of the lower window of FIG. 2.
Figure 8:
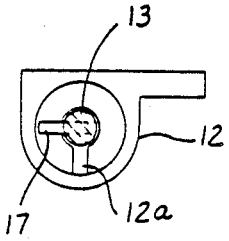
FIG. 8 is a view taken along the line X—X in FIG. 7.

In FIG. 2, the state of the upper and lower windows 1 and 2 being pushed open is shown in phantom lines. As can be seen in this figure, an opening 22 serving as a ventilation passage is defined in the region below the lower window 2, while openings 23 and 24 also serving as ventilation passages are defined in the opposite lateral sides of the upper and lower windows 1 and 2. By adjusting the level of the lower end of the lower window 2, the size of the opening in the region below the lower window 2 is adjusted and at the same time the angle defined between the upper and lower windows 1 and 2 is changed and so is the size of the openings 23 and 24.

Thus, by adjusting the size of the openings 22 through 24 according to the degree of pollution of the air and temperature in the room, optimum ventilation can be attained.

Figure 9:
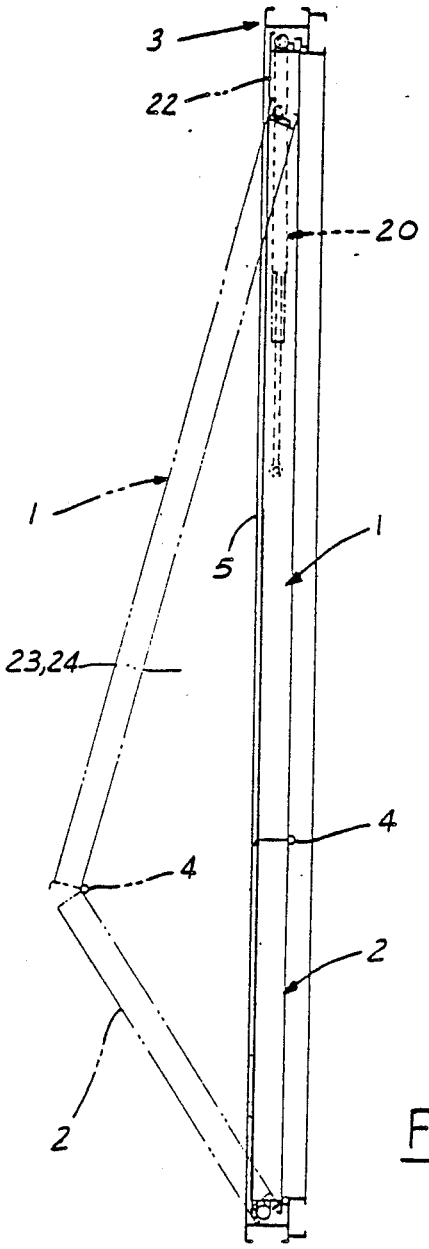
FIG. 9 is a side view schematically showing the arrangement of the second embodiment of a bendable multiple window according to the invention.
Figure 10:
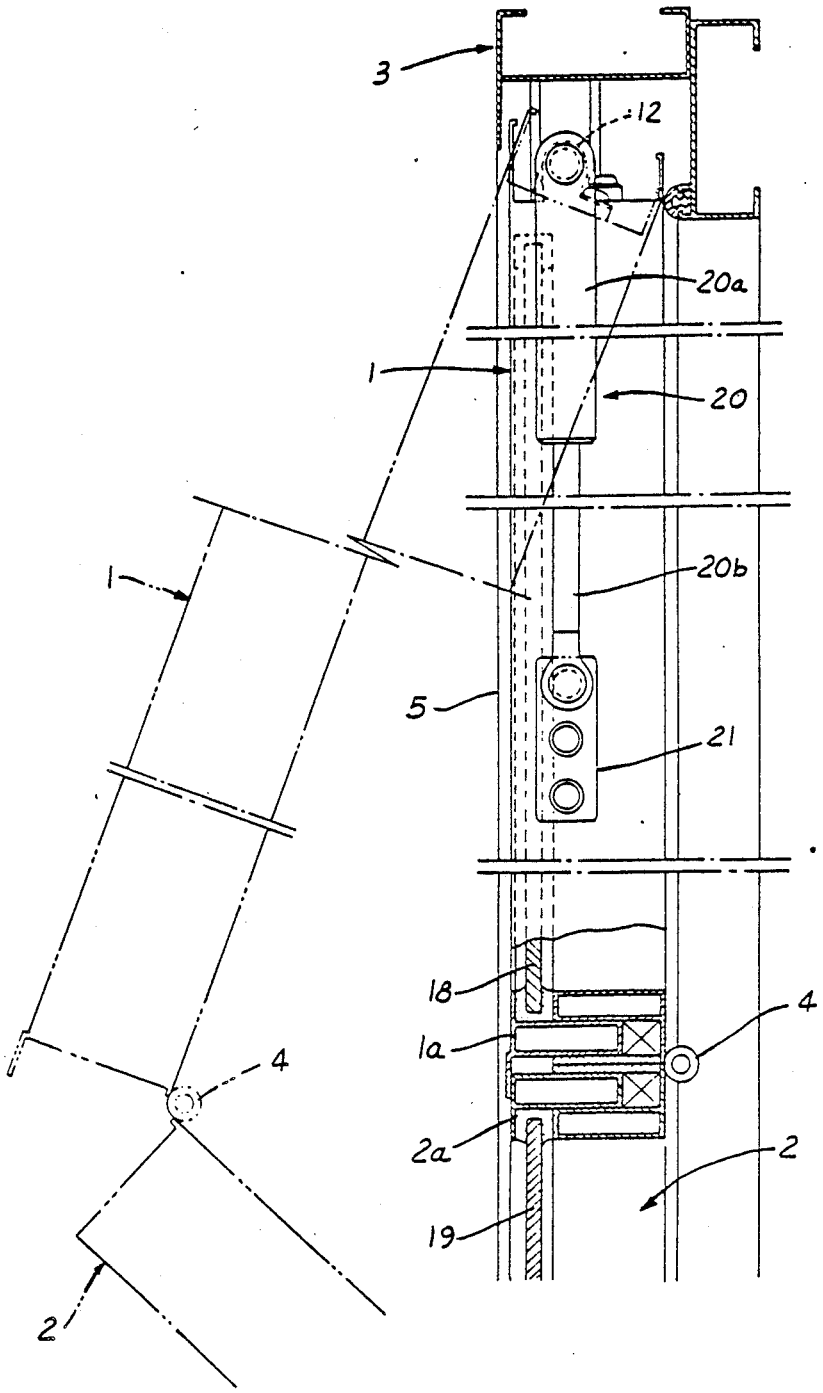
FIG. 10 is an enlarged fragmentary side view of the damper attaching portion of FIG. 9.
Figure 11:
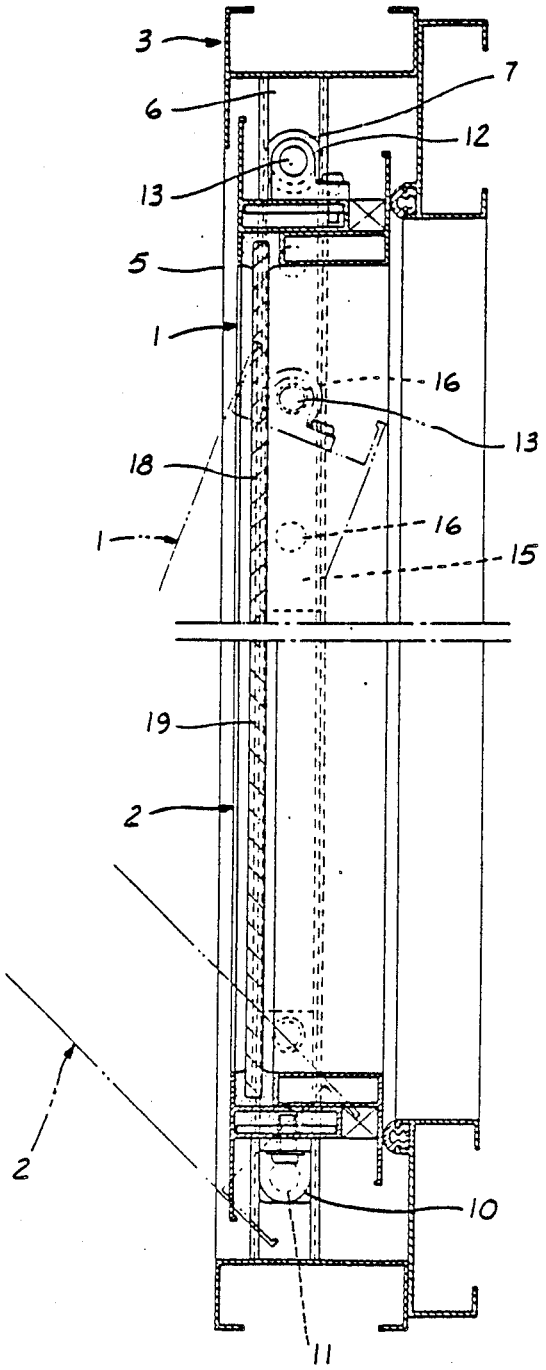
FIG. 11 is an enlarged side view of the upper and lower end portions of the bendable multiple window of FIG. 9.

The second embodiment of the invention will now be described with reference to FIGS. 9 through 11.

In this embodiment, contrary to the first embodiment, rollers 7 respectively supported by blocks 12 on the upper end of the upper window 1 on opposite sides fit in guide grooves 6. The lower window 2 is rotatable around the axes of shaft portions 11 supported by blocks 10 attached to the lower window 2. Each damper 20 is pivotally connected at its lower end, i.e., at the front end of its rod 20*b* to the associated lateral frame 5 of the window attaching framework 3 through an attaching element 21. The upper end of the damper 20, i.e., the upper end of the body 20*a* is pivotally connected to the associated block 12 of the window 1.

The block 12 of the upper window 1 has a shaft 13 inserted therein, the front end of said shaft 13 being adapted to fit in vertically spaced holes 16 which are formed in a locking plate 15 associated with the upper end of the upper window 1.

The detailed constructions of the blocks 10 and 12 and their related parts are the same as in FIGS. 5 through 8.

In such arrangement, when the connecting portion defined by hinges 4 between the upper and lower windows 1 and 2 is pushed to open the windows, the lower window 2 is turned around the axes of the shaft portions 11 while the upper window 1 is turned around the axes of the shafts 13 while moving downward against the urging forces of the dampers 20. That is, the lowering speed of the upper end of the upper window 1 is moderated and the upper and lower windows 1 and 2 are simultaneously opened. When the upper and lower windows 1 and 2 are to be closed, they will be closed also simultaneously. During this closing movement, the upper window 1 is pushed up by the dampers 20 in the closing direction, so that it can be lightly closed. The provision avoids shocks occurring during the opening and closing of the windows 1 and 2.

The third embodiment of the invention will now be described with reference to FIGS. 12 through 15.

In this embodiment, rollers 7 are provided on the upper end of the upper window 1 on opposite sides and on the lower end of the lower window 2 on opposite sides. These rollers 7 vertically slidably fit in guide grooves 6. The rollers 7 of the lower window 2 are supported by blocks 10 which are of the same arrangement as the one shown in FIG. 7. Locking plates 15 each having a plurality of vertically spaced holes 16 as in the first and second embodiments are respectively attache to the opposite lateral frames 5 associated with the lower end of the lower window 2.

The rollers 7 of the upper window 1 are respectively supported by blocks 26, each block 26 having a horizontal shaft 27 inserted therein, the front end 27*a* of said shaft 27 having the associated roller 7 rotatably fitted thereon. Each block 26 contains a spring 28 fitting on the shaft 27, said spring 28 urging the shaft 27 to fit in the associated roller 7. The urging force of the spring 28 moves the shaft 27 until its front end 27*a* fits in the roller 7. The other end of the shaft 27 is formed with a flange 27*b* adapted to abut against the end surface of the block 26.

Figure 14:
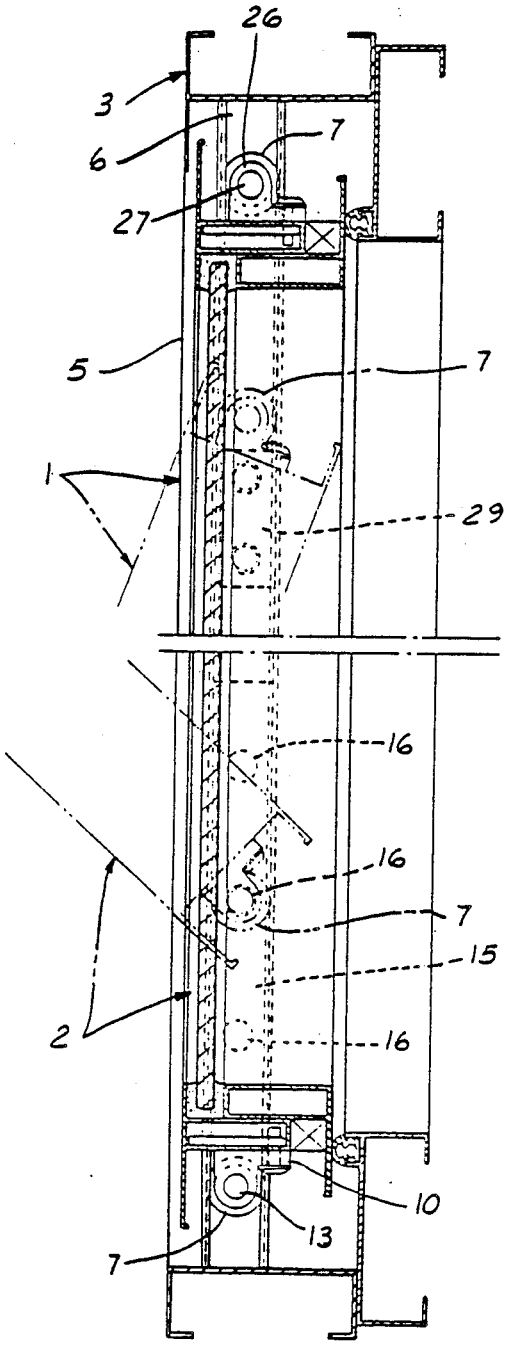
FIG. 14 is an enlarged side view, in section, of the upper and lower end portions of the bendable multiple window of FIG. 12.
Figure 15:
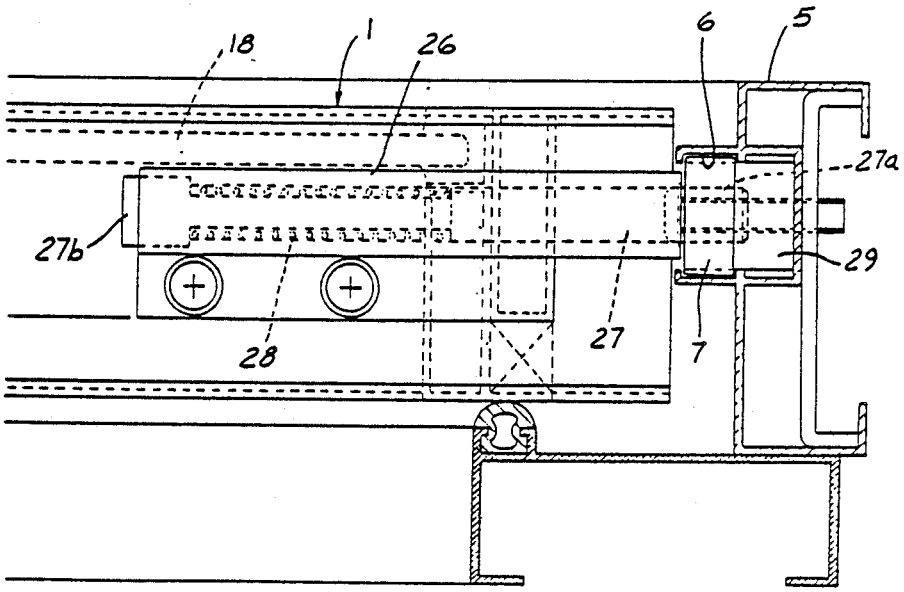
FIG. 15 is an enlarged plan view, in section, of the roller attaching portion of the upper window of FIG. 12.

As shown in FIGS. 14 and 15, a stopper 29 is installed in the guide groove 6 in the upper portion of the window attaching framework 3. The stopper 29 is adapted to receive the associated roller 7 when the upper window 1 has been opened to the maximum degree.

The upper window 1 is supported by dampers 20 respectively interposed between the right and left lateral frames 5 of the window attaching framework 3 and lateral frames 1*b* of the window 1. The lower end of each damper 20, i.e., the lower end of its body 20*a* is pivotally connected to the associated lateral frame 5 of the window attaching framework 3 through an attaching element 21. The upper end of each damper 20, i.e., the front end of its rod 20*b* is pivotally connected to a place at a suitable level on the associated lateral frame lb of the window 1 through an attaching element 25.

In such construction, when the connecting portion defined by hinges 4 between the upper and lower windows 1 and 2 is pushed to open the windows, first the upper window 1 is opened as it is bent with its weight supported by the dampers 20. At this time, the lower window 2 is only turned around the axes of the shafts 13 but is not moved upward. The lowering speed of the upper end of the upper window 1 is moderated by the dampers 20. As the degree of opening of the windows 1 and 2 increases, the rollers 7 respectively abut against the stoppers 29, whereupon the lower end of the lower window 2 begins to move upward. Finally, by inserting the front ends of the shafts 13 in desired ones of the holes 16, the opened state of the window 1 and 2 is maintained.

During the closing of the windows 1 and 2, the upper window 1 can be closed with a light force since it is pushed up in the closing direction by the dampers 20.

Figure 12:
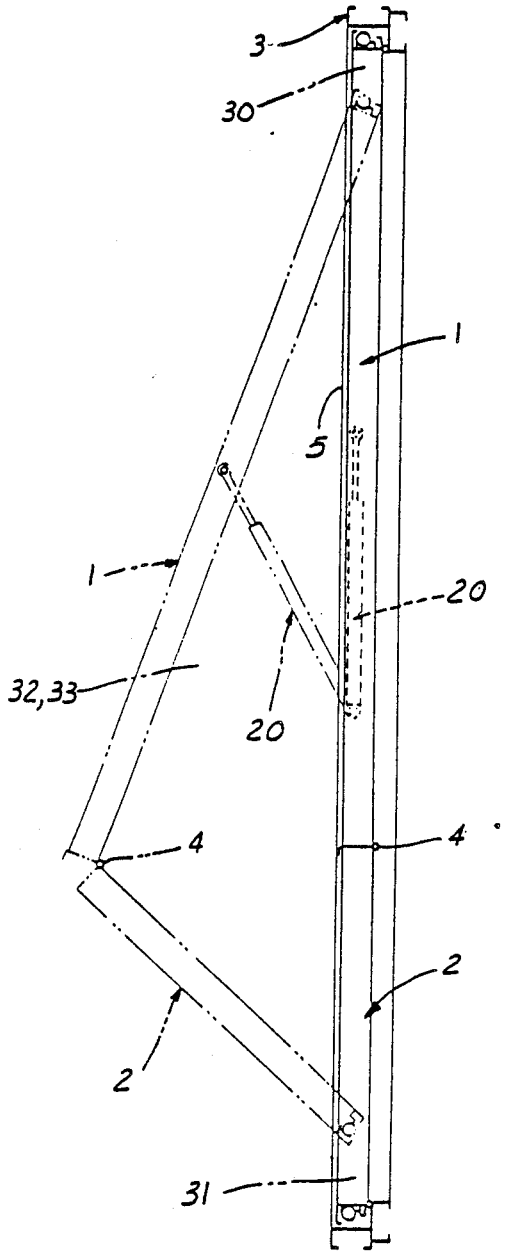
FIG. 12 is a side view schematically showing the arrangement of the third embodiment of a bendable multiple window according to the invention.
Figure 13:
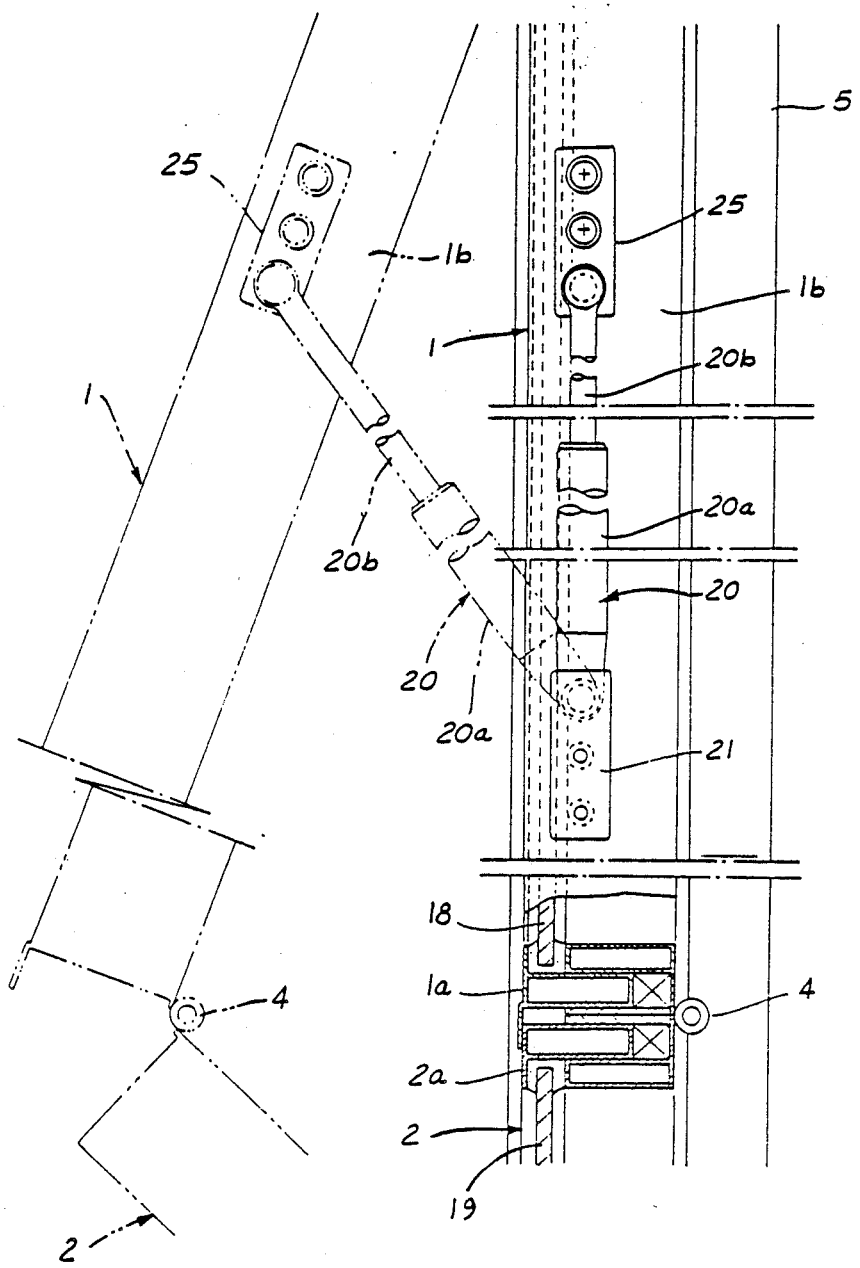
FIG. 13 is an enlarged fragmentary side view of the damper attaching portion of FIG. 12.

In FIG. 12, the state of the upper and lower windows 1 and 2 being pushed open is shown in phantom lines. As can be seen in this figure, openings 30 and 31 serving as ventilation passages are defined above the upper window 1 and below the lower window 2, respectively, and openings 32 and 33 serving as ventilation passages are defined in the opposite lateral sides of the upper and lower windows 1 and 2. In the case where the opening 31 defined below the lower window 2 is not desired, the lower end of the lower window 2 may be lowered. The size of the opening 31 defined below the lower window 2 can be changed by a combination of each shaft 13 and a plurality of holes 16. By adjusting these openings 30 through 33, optimum ventilation can be attained according to the degree of pollution of the air and temperature in the room. The provision of the upper and lower openings 30 and 31 improves ventilation.

Figure 16:
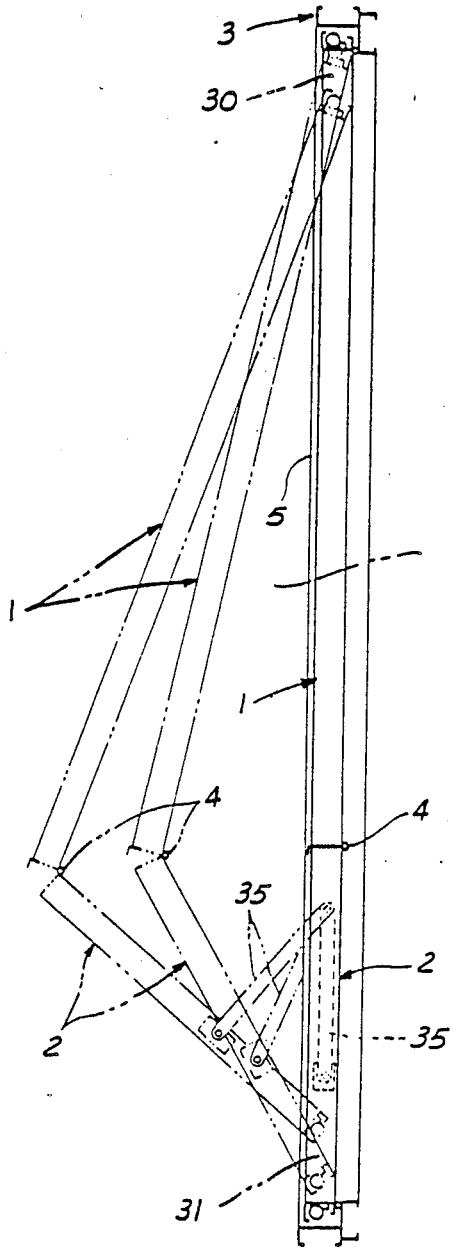
FIG. 16 is a side view schematically showing the arrangement of the fourth embodiment of a bendable multiple window according to the invention.
Figure 17:
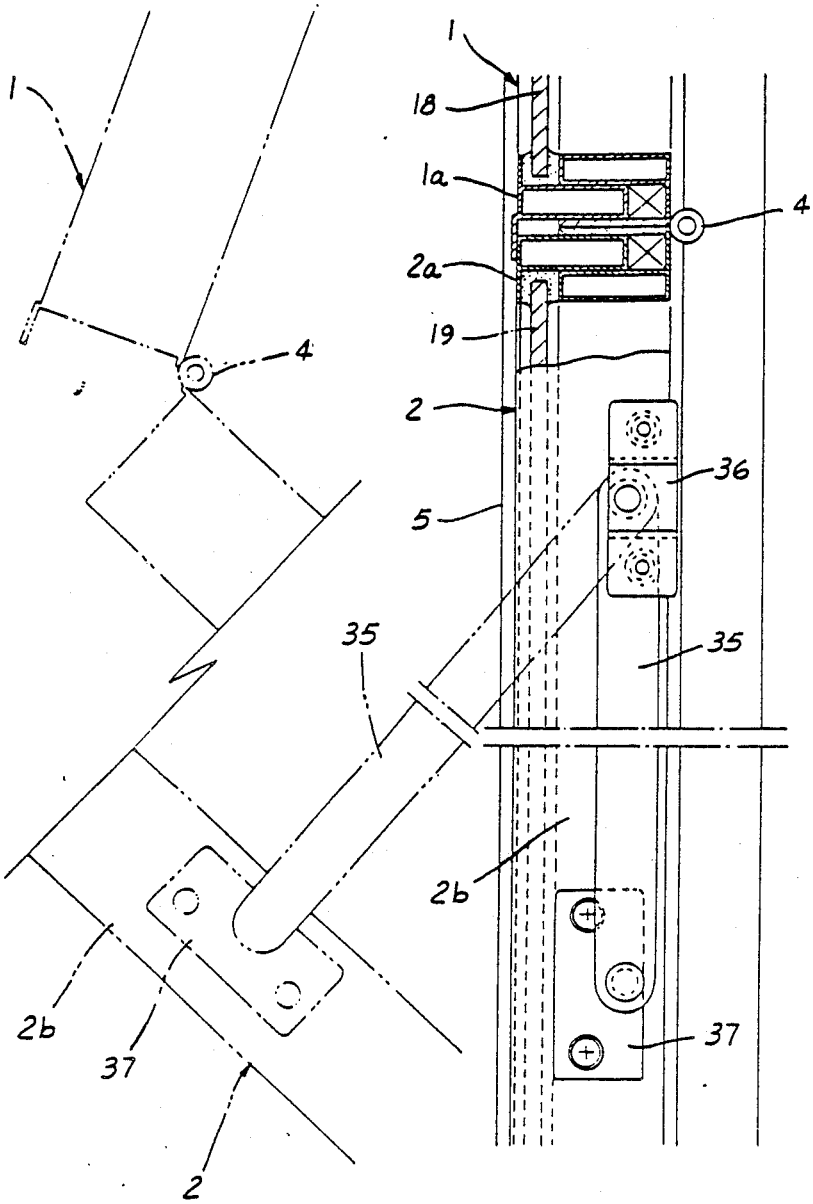
FIG. 17 is an enlarged fragmentary side view of the arm attaching portion of FIG. 16.

The fourth embodiment of the invention will now be described with reference to FIGS. 16 and 17.

In this embodiment, the dampers 20 used in the third embodiment shown in FIGS. 12 through 15 are replaced by arms 35. The arms 35 are respectively connected between the right and left lateral frames 5 of the window attaching framework 3 and the lateral frames 2*b* of the window 2. The upper end of each arm 35 is pivotally connected to the associated lateral frame 5 of the window attaching framework 3, while the lower end of each arm 35 is pivotally connected to a place at a suitable level on the associated lateral frame 2*b* of the window 2.

According to such arrangement, the presence of the arms 35 ensures that when the connecting portion defined by hinges 4 between the upper and lower windows 1 and 2 is pushed to open the window, the upper window 1 is opened as the lower window 2 is opened while the upper end of the upper window 1 moves downward as the lower end of the lower window 2 moves upward. At this time, the presence of the arms 35 moderates the movements of the two windows 1 and 2, so that the windows 1 and 2 can be slowly opened without producing shocks.

Figure 18:
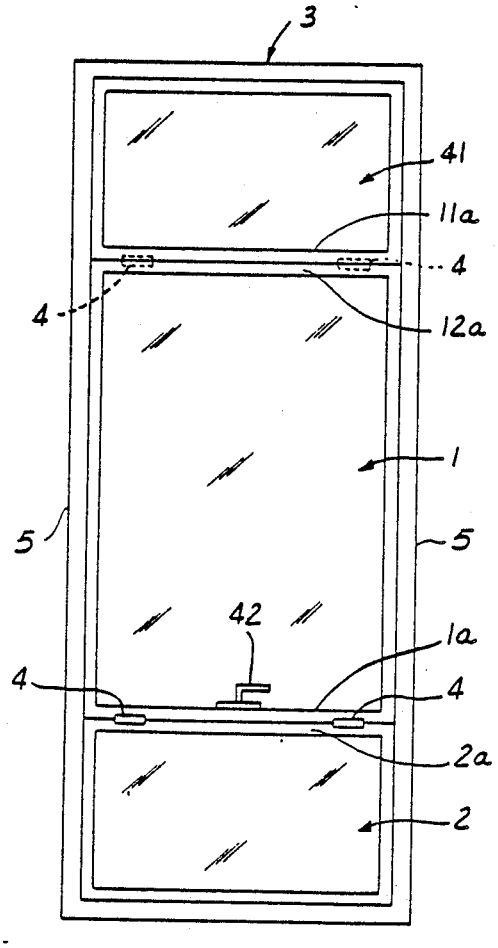
FIG. 18 is a front view schematically showing the arrangement of the fifth embodiment of a bendable multiple window according to the invention.

The fifth embodiment of the invention will now be described with reference to FIGS. 18 and 19.

In this embodiment, in addition to the upper and lower windows 1 and 2, a third window 41 is provided. The third window 41 is bendably connected at the lower end thereof to the upper end of the upper window 1 by hinges 4. The third window 41 is adapted to slide up and down along guide grooves 6 while maintaining its vertically directed position, its downward movement being stopped at a predetermined position by stoppers similar to the stoppers 29 shown in FIGS. 14 and 15. Dampers 20 are connected between the middle regions of the lateral sides of the upper window 1 and the lateral frames 5 of the window attaching framework 3.

Figure 19:
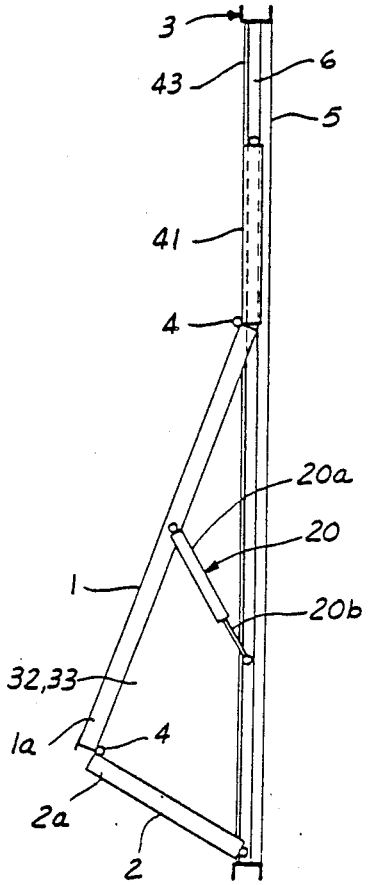
FIG. 19 is a side view schematically showing the arrangement of the bendable multiple window of FIG. 18.

In such arrangement, when a handle 42 installed on the connecting portion between the upper and lower windows 1 and 2 is gripped and pushed outward, the third window 41 moves downward along the guide grooves 6, as shown in FIG. 19. The upper and lower windows 1 and 2 are opened as they are bent with their connecting portions projecting out of the window attaching framework 3. As a result, an opening 43 is defined above the third window 41 while triangular openings 32 and 33 are defined in the opposite lateral sides of the upper and lower windows 1 and 2. The state of the three windows 1, 2 and 41 being opened is maintained by the third window 41 abutting against said stoppers. Besides this, it is possible to utilize the locking means described in the first through fourth embodiments.

The window attaching framework 3 could be vertically enlarged to admit more light, and even in such case, the provision of the three windows 1, 2 and 41 makes it possible to reduce the amount by which the bendable multiple window projects when opened.

Figure 20:
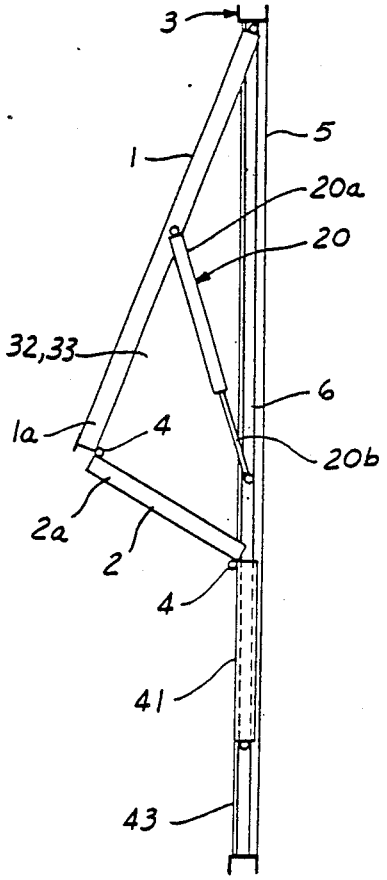
FIG. 20 is a side view schematically showing the arrangement of the sixth embodiment of a bendable multiple window according to the invention.

The sixth embodiment of the invention is shown in FIG. 20.

In this embodiment, the third window 41 is provided below the lower window 2 and is bendably connected at the upper end thereof to the lower end of the lower window 2 by hinges 4. Dampers 20 are connected between the middle regions of the lateral sides of the upper window 1 and the lateral frames 5 of the window attaching framework 3.

According to such arrangement, during opening, openings 43, 32, 33 are defined below the third window 41 and in the opposite lateral sides of the upper and lower windows 1 and 2.

Figure 21:
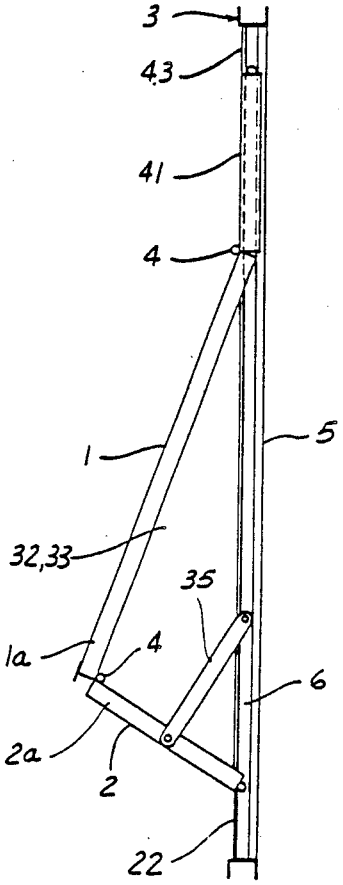
FIG. 21 is a side view schematically showing the arrangement of the seventh embodiment of a bendable multiple window according to the invention.

The seventh embodiment of the invention is shown in FIG. 21.

In this embodiment, the lower end of the lower window 2 is adapted to be raised and lowered along guide grooves 6 in contrast to the bendable multiple window of FIG. 19. Further, the dampers 20 of FIG. 19 are replaced by arms 35.

According to such arrangement, openings 22 and 43 are defined above the third window 41 and below the lower window 2. The lower window 2 is locked in the opened state by the same arrangement as the shown in FIG. 3.

Figure 22:
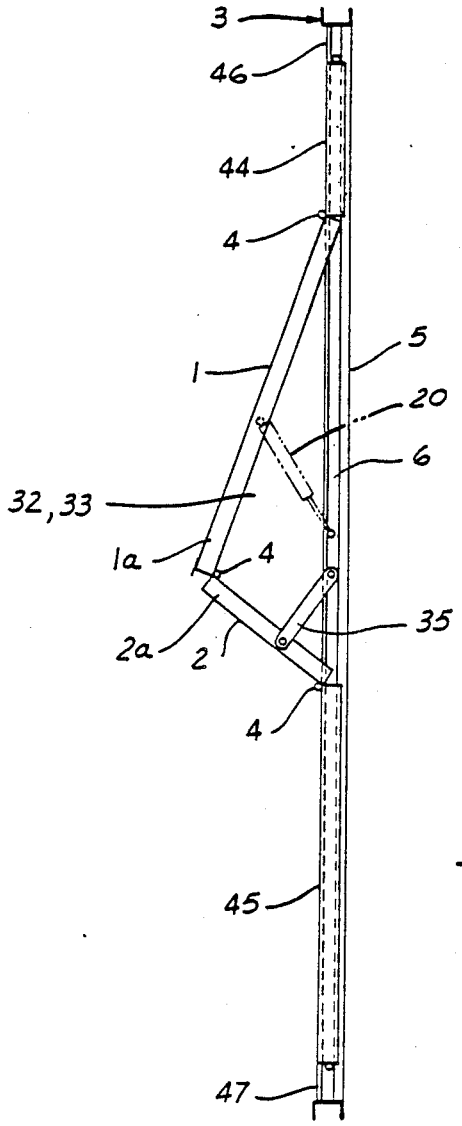
FIG. 22 is a side view schematically showing the arrangement of the eighth embodiment of a bendable multiple window according to the invention.

The eighth embodiment of the invention is shown in FIG. 22.

In this embodiment, the third window 44 is connected to the upper end of the upper window 1 and a fourth window 45 is connected to the lower end of the lower window 2. The numeral 46 and 47 denote openings defined above or below the two windows 44 and 45.

As shown in solid lines in FIG. 22, arms 35 are connected between the lower window 2 and the window attaching framework 3. Alternatively, as shown in broken lines in this figure, in place of or in addition to the arms 35, dampers 20 may be connected between the upper window 1 and the window attaching framework 3.

What is claimed is:

1. A folding window assembly comprising:

a window attaching framework installed in a building and having opposite lateral frames, a lower window and an upper window, said windows having adjacent portions foldably connected together and remote portions engaging said opposite lateral frames, 'said adjacent portions being free of said opposite lateral frames and projecting outwardly therefrom to form triangular openings when said remote portions of said windows are moved relatively toward one another, supporting means installed between at least one of said windows and the window attaching framework, locking means for holding at least one of said windows in a predetermined opened state, a third window foldably connected to the remote portion of one of said upper and lower windows, said third window being vertically movable along the opposite lateral frames of the window attaching framework while being disposed vertically, and a fourth window foldably connected to the remote portion of the other of said upper and lower windows, said fourth window being vertically movable along the opposite lateral frames of the window attaching framework while being disposed vertically.

* * * * *